US007581856B2

(12) United States Patent
Kang et al.

(10) Patent No.: US 7,581,856 B2
(45) Date of Patent: Sep. 1, 2009

(54) HIGH POWER LED LIGHTING ASSEMBLY INCORPORATED WITH A HEAT DISSIPATION MODULE WITH HEAT PIPE

(75) Inventors: Shung-Wen Kang, Danshuei Township, Taipei County (TW); Meng-Chang Tsai, Bade (TW); Kun-Cheng Chien, Danshuei Township, Taipei County (TW)

(73) Assignee: Tamkang University, Taipei County (TW)

( * ) Notice: Subject to any disclaimer, the term of this patent is extended or adjusted under 35 U.S.C. 154(b) by 159 days.

(21) Appl. No.: 11/783,638

(22) Filed: Apr. 11, 2007

(65) Prior Publication Data

US 2008/0253125 A1 Oct. 16, 2008

(51) Int. Cl.
*F21V 29/00* (2006.01)

(52) U.S. Cl. ..... 362/373; 362/255; 362/294

(58) Field of Classification Search ..... 362/96, 362/218, 255, 256, 264, 294, 345, 373, 547, 362/800

See application file for complete search history.

(56) References Cited

U.S. PATENT DOCUMENTS 7,014,337 B2 * 3/2006 Chen ..... 362/800
2007/0230172 A1 * 10/2007 Wang ..... 362/294
2007/0253202 A1 * 11/2007 Wu et al. ..... 362/294
2008/0007955 A1 * 1/2008 Li ..... 362/294

OTHER PUBLICATIONS

Shung-Wen Kang; Meng-Chang Tsai; Kun-Cheng Chien; Evaluating Heat Pipe Used in High Power LEDs for Outdoor Landscape Lighting Application; 8th International Heat Pipe Symposium; Sep. 24, 2006, Kumamoto, Japan.

* cited by examiner

*Primary Examiner*—Y My Quach Lee
(74) *Attorney, Agent, or Firm*—Rosenberg, Klein & Lee

(57) ABSTRACT

A high power light emitting diode (LED) lighting assembly incorporated with heat dissipation module is provided. The LED lighting assembly includes a heat exchange base, at least one LED array, at least one heat pipe and a heat dissipation module. The heat exchange base includes at least one LED configuration plan for mounting of the LED array and at least a hollow part for insertion of the heat pipe. The LED array is arranged at a predetermined projecting angle at the LED configuration plane. The heat pipe includes a heated section, a cooling section and a conducting section, and contains a working fluid therein. The heat exchange base is mounted to the heated section and the heat dissipation module is mounted to the cooling section. The thermal energy generated by the LEDs is conducted from the heat exchange base to the heated section of the heat pipe, whereby allowing the working fluid in the heat pipe to be heated and vaporized, and flows, from the conducting section to the cooling section for dissipation at the heat dissipation module.

6 Claims, 12 Drawing Sheets

HIGH POWER LED LIGHTING ASSEMBLY INCORPORATED WITH A HEAT DISSIPATION MODULE WITH HEAT PIPE

FIELD OF THE INVENTION

The present invention relates to a design for a light emitting diode (LED) lighting assembly, and in particular to a high power LED lighting assembly incorporated with a heat dissipation module using heat pipe that is capable of dissipating heat effectively from the LED lighting assembly.

BACKGROUND OF THE INVENTION

According to the conclusion of Kyoto Global Climate Conference, many countries have to cut their greenhouse gas emissions to below 6% to 1990 level in years between 2008 and 1012. With the power consumption for lighting purposes accounting for more than 20% of the livelihood-based energy, the development of energy saving lighting technology becomes even more important.

Light-emitting diode (LED), an optoelectronic semiconductor component that radiates by applying external voltage to simulate the electrons to produce lighting, provides the advantages of low power consumption and long service life, therefore prompting the worldwide researches and development of the related technologies. Practical applications currently are generally limited to low power indicator lamps, but with the active developments on high power LED technology in recent years. The illumination wattage is gradually improving, showing its potential for replacing conventional incandescent light bulb for lighting. Besides, the illumination efficiency of LED is soon expected to exceed 80 limens per watt, which is about six times the illumination efficiency of the conventional incandescent tungsten light bulb. In order to provide sufficient flux of light for lighting device, current designs include the assembly of arrayed LEDs with dozens of hundreds of LED lamps being packed together in wide range of applications from outdoor display to lighting.

However, with high power LED advancing, the heat generated by high power LED is also increased, and the dissipation of heat from LED becomes a critical problem. During operation, the illumination of LED lamps generates hot spots of high temperature in radiating area on high power LED, and currently, no solution is provided. This problem limits the development and applications of LED lamps. The poor heat dissipation of hot spots results to the overheating of LED lamps. When the junction temperature exceeds 120° C., the high temperature damages the LED lamps and leads to lower performance of LED, shorter service life, and even the peril of burnout. Hence, to promote the application of LED, the heat dissipation must be effectively settled.

Thus, it is desired to develop a LED device of high power and a means for effectively dissipate heat from a LED device for enhancing the performance, service lifespan, and reliability of lighting devices.

SUMMARY OF THE INVENTION

A primary object of the present invention is to provide a high power LED lighting assembly that comprises a plurality of arrays of LED for emitting light. The LED lighting assembly provides sufficient illumination with low power consumption, which can replace conventional incandescent light bulbs and florescent light sources.

Another object of the present invention is to provide a heat dissipation module for dissipating heat. The heat dissipation module comprises at least one heat pipe for conducting heat from the heated section of the heat pipe to the cooling region which is fitted to a heat dissipation module for dissipating the heat efficiently.

A further object of the present invention is to provide a heat dissipation module for incorporating to a LED light assembly. The heat dissipation module is capable to effectively remove heat from the LEDs to the outside, and maintain the LED light assembly at an appropriate operation temperature. The arrangement of the heat dissipation module eliminates the overheating at any spots of the heat dissipation module and maintains the lighting stability of heat dissipation module.

To fulfill the above objects, the present invention provides a high power LED lighting assembly incorporated with a heat dissipation module for incorporating to the LED light assembly. The LED lighting assembly comprises a heat exchange base, at least one LED array, at least one heat pipe and a heat dissipation module. The heat exchange base comprises at least one LED configuration plan for mounting of the LED array and at least a hollow part for insertion of the heat pipe. The LED array is arranged at a predetermined projecting angle at the LED configuration plane. The heat pipe comprises a heated section, a cooling section and a conducting section, and contains a working fluid. The heat exchange base is mounted to the heated section and the heat dissipation module is mounted to the cooling section. The thermal energy generated by the LEDs is conducted from the heat exchange base to the heated section of the heat pipe, whereby allowing the working fluid in the heat pipe to be heated and vaporized, and flows, from the conducting section to the cooling section for dissipation at the heat dissipation module.

BRIEF DESCRIPTION OF THE DRAWINGS

The present invention will be apparent to those skilled in the art by reading the following description of preferred embodiment thereof, with reference to the attached drawings, in which.

DETAILED DESCRIPTION OF THE PREFERRED EMBODIMENTS

Figure 1:
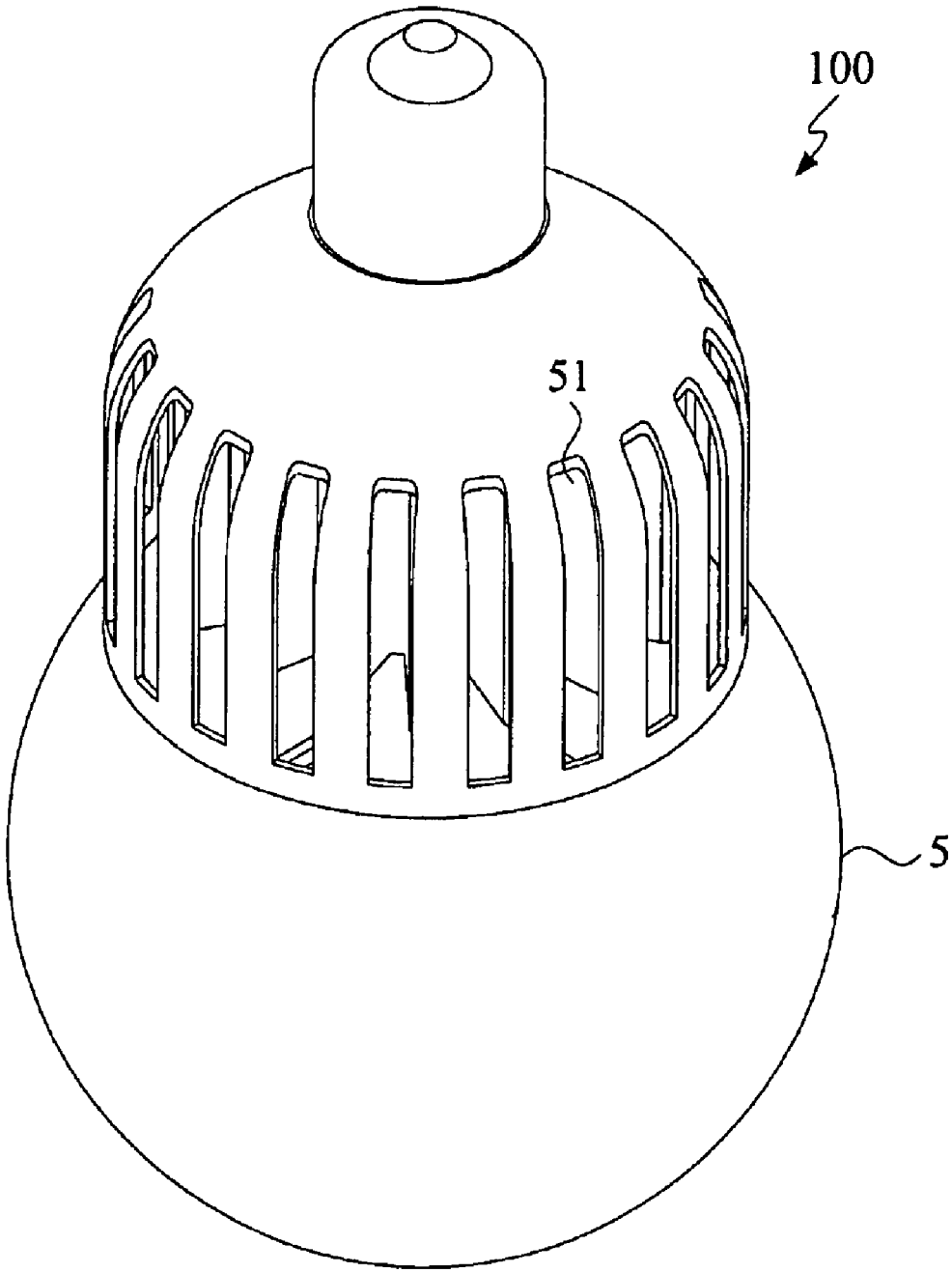
FIG. 1 is a schematic view of a first embodiment of a high power LED lighting assembly incorporated with a heat dissipation module constructed in accordance with the present invention.
Figure 2:
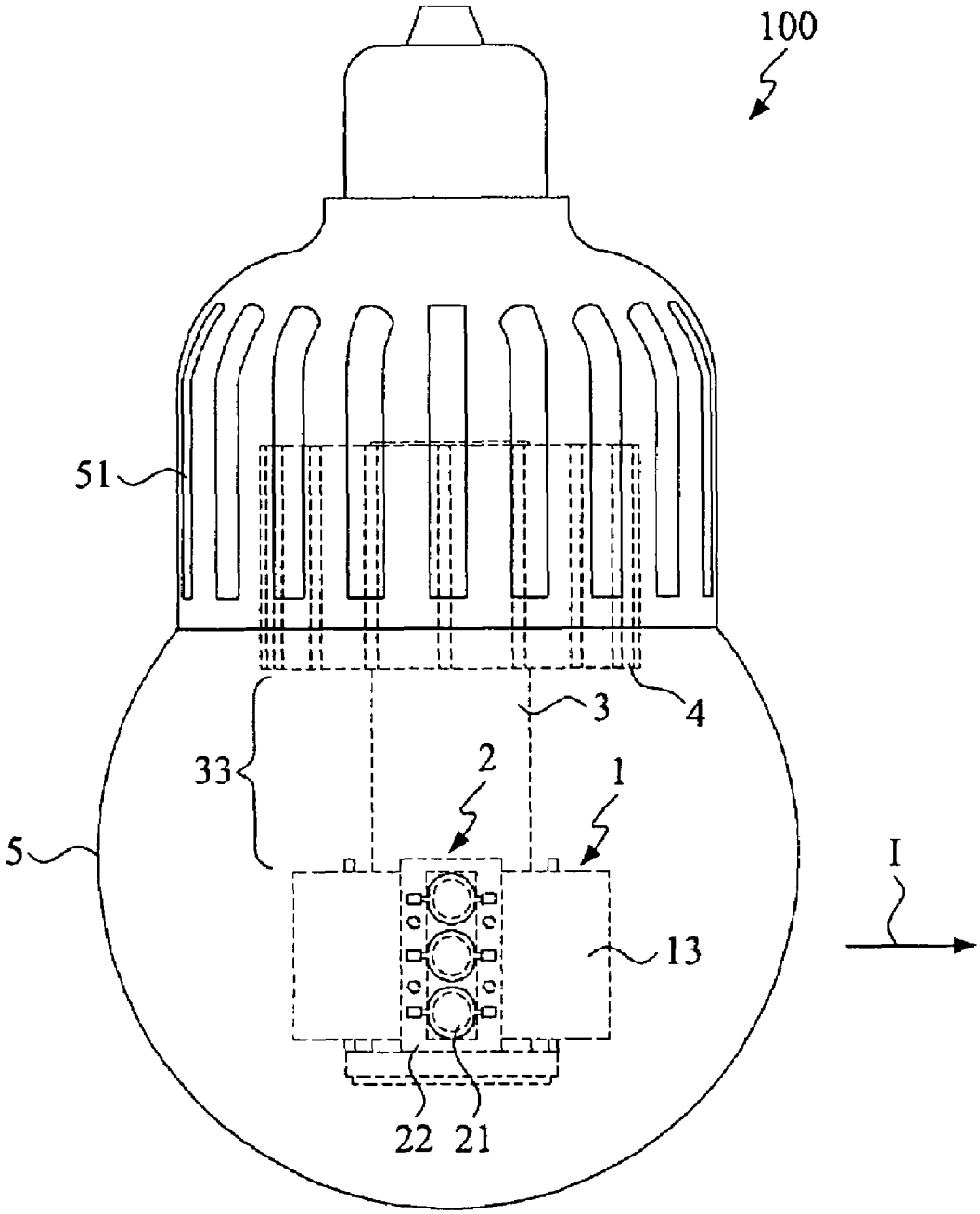
FIG. 2 is a perspective side view showing the components of the LED lighting assembly of FIG. 1.
Figure 3:
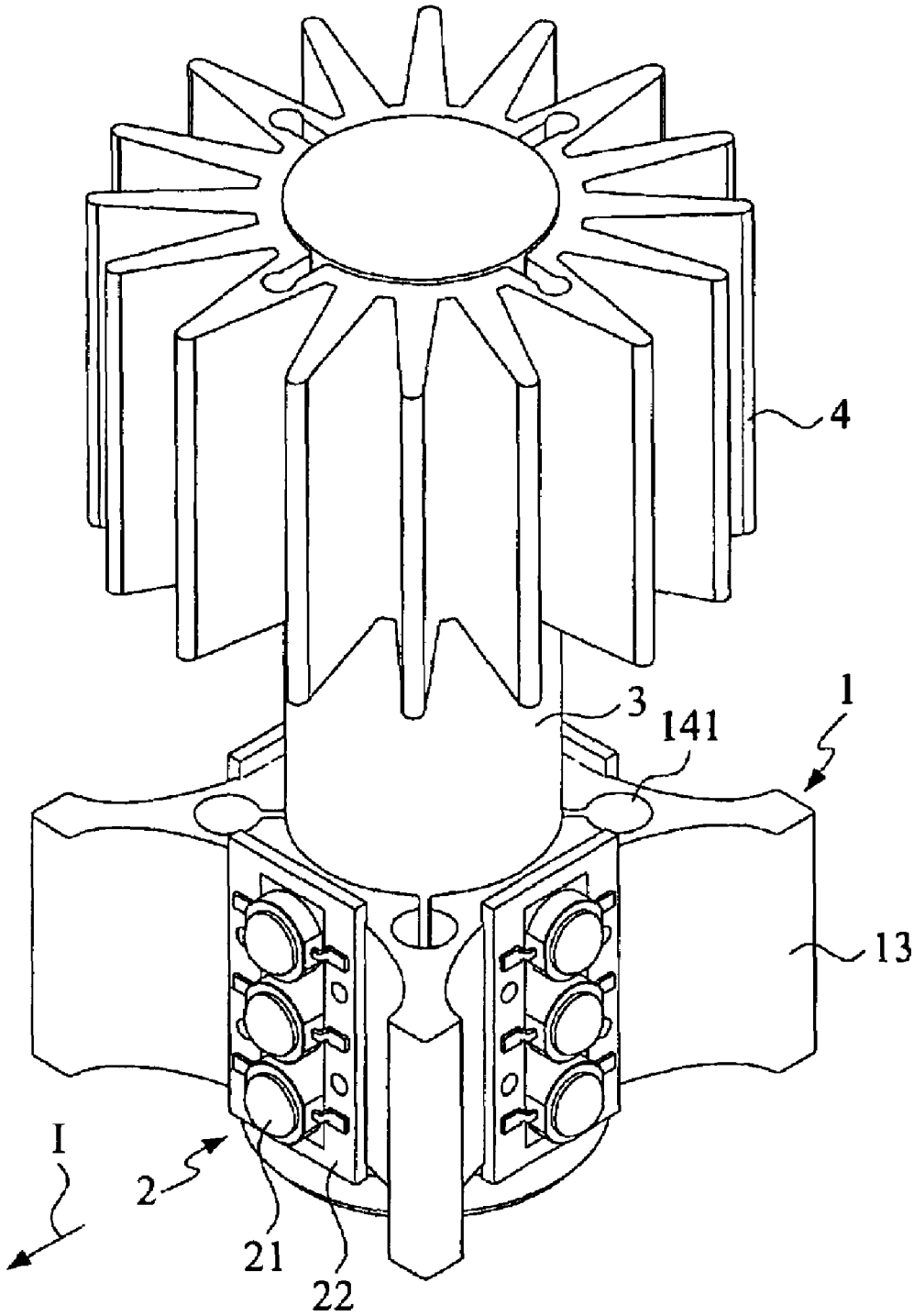
FIG. 3 is a schematic view of the LED lighting assembly of FIG. 1 after the removal of its lamp shade.

With reference to the drawings and in particular to FIGS. 1 to 3, a first embodiment of a high power LED lighting assembly incorporated with heat dissipation module constructed in accordance with the present invention, generally designated with reference numeral 100, is shown. The high power LED lighting assembly 100 of the present invention comprises a heat exchange base 1, a plurality of LED arrays 2, a heat pipe 3, a heat dissipation module 4, and a lamp shade 5. The lamp shade 5 covers the heat exchange base 1, the LED arrays 2, the heat pipe 3 and the heat dissipation module 4, and is removable for maintenance of the components. The heat exchange base 1 is arranged at the lower part of the LED lighting assembly 100 and the heat dissipation module 4 is arranged at the upper part of the LED lighting assembly 100.

Figure 4:
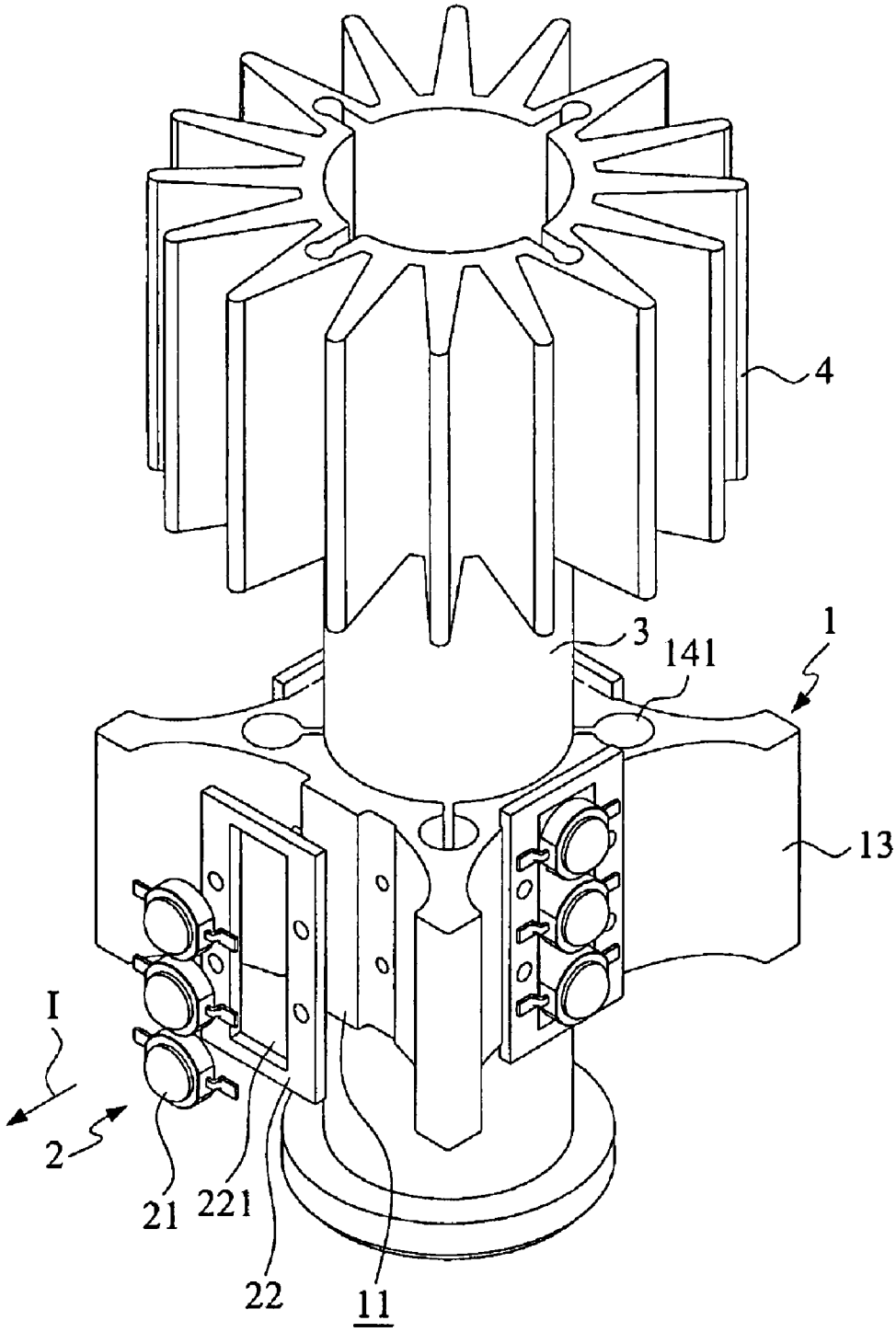
FIG. 4 is a partial exploded schematic view showing the arrangement of LED array of the LED lighting assembly of FIG. 3.
Figure 5:
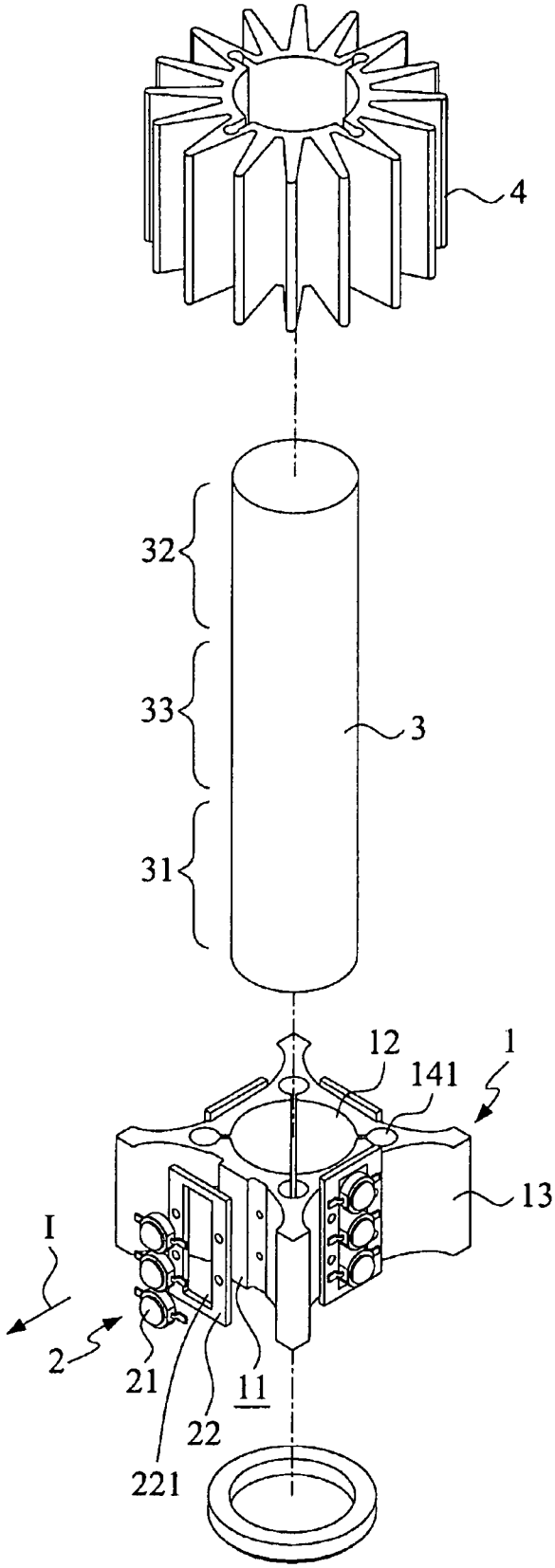
FIG. 5 is an exploded schematic view of the LED lighting assembly of FIG. 3.
Figure 6:
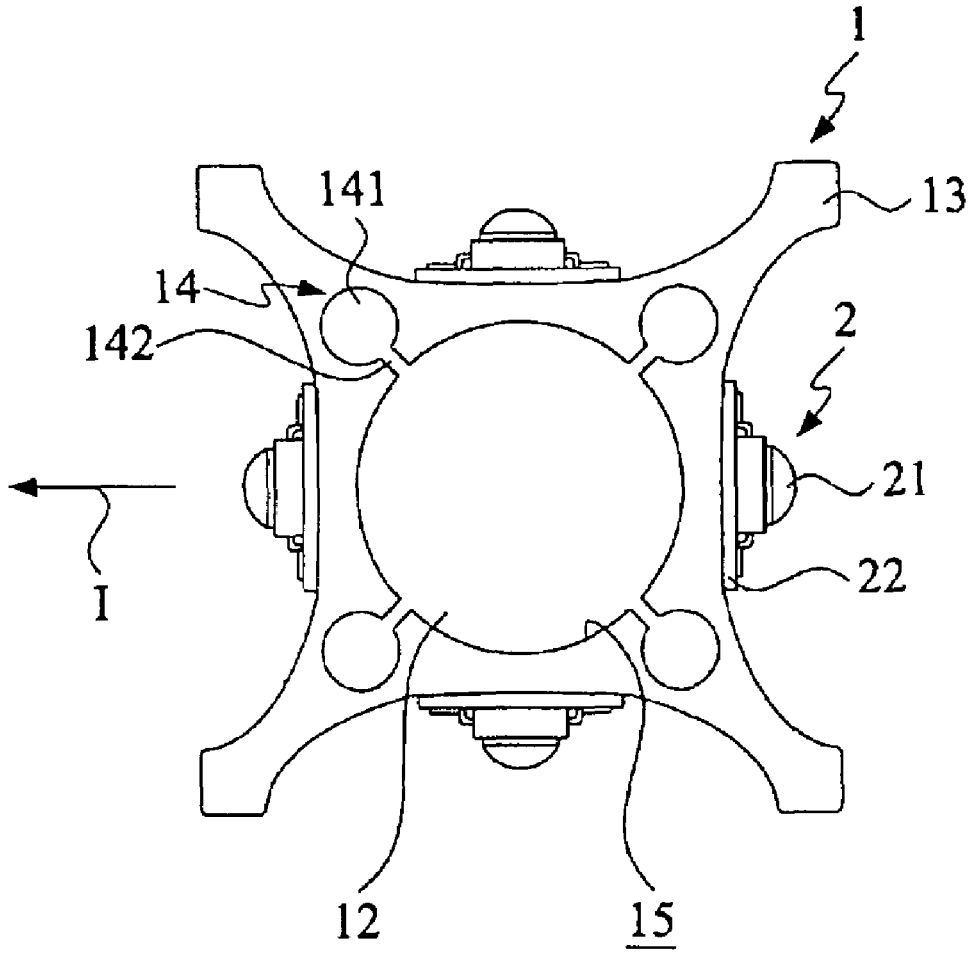
FIG. 6 is a top plan view of a heat exchange base of the LED lighting assembly.
Figure 7:
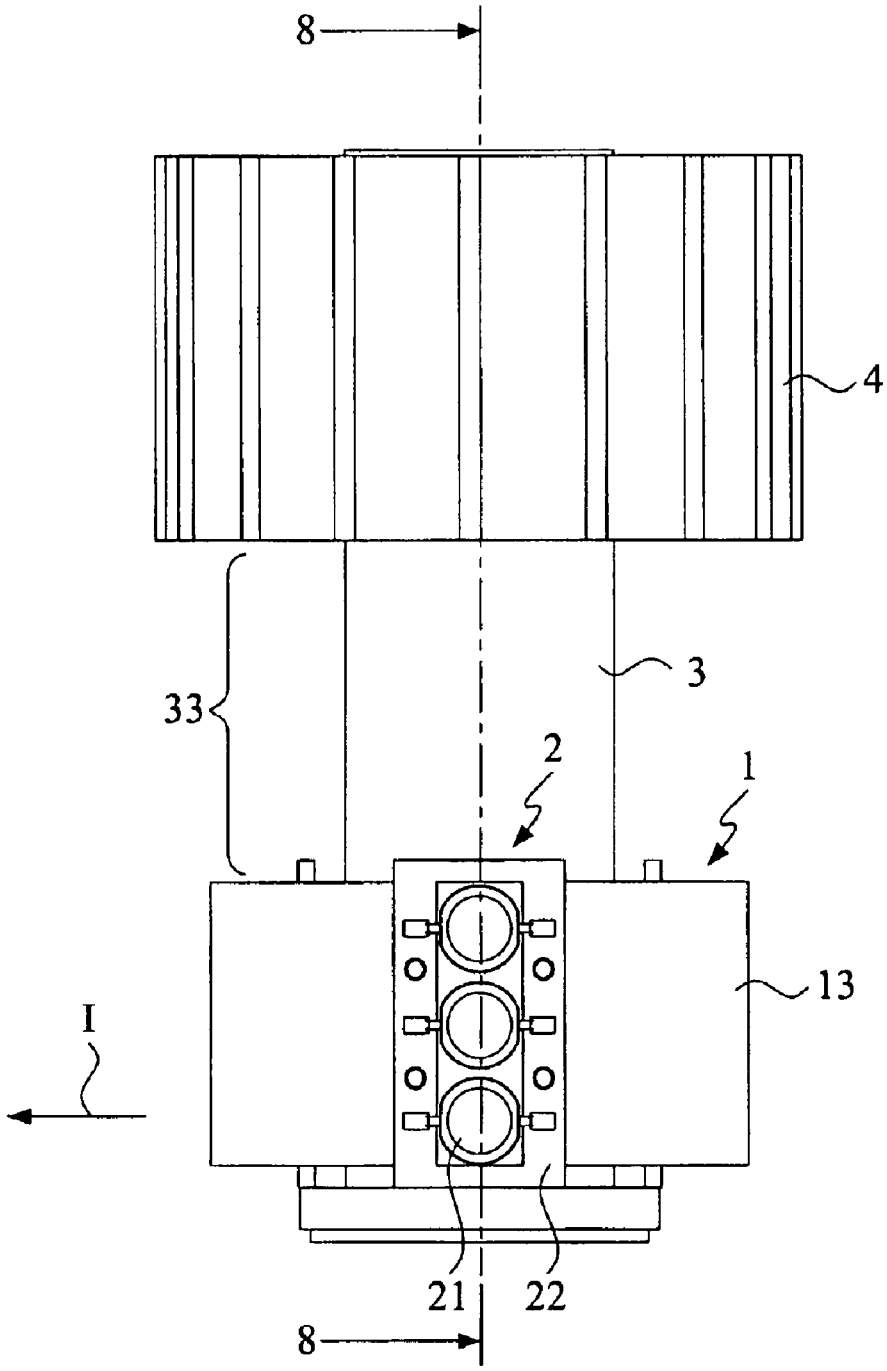
FIG. 7 is a schematic side view of the of the LED lighting assembly of FIG. 3.
Figure 8:
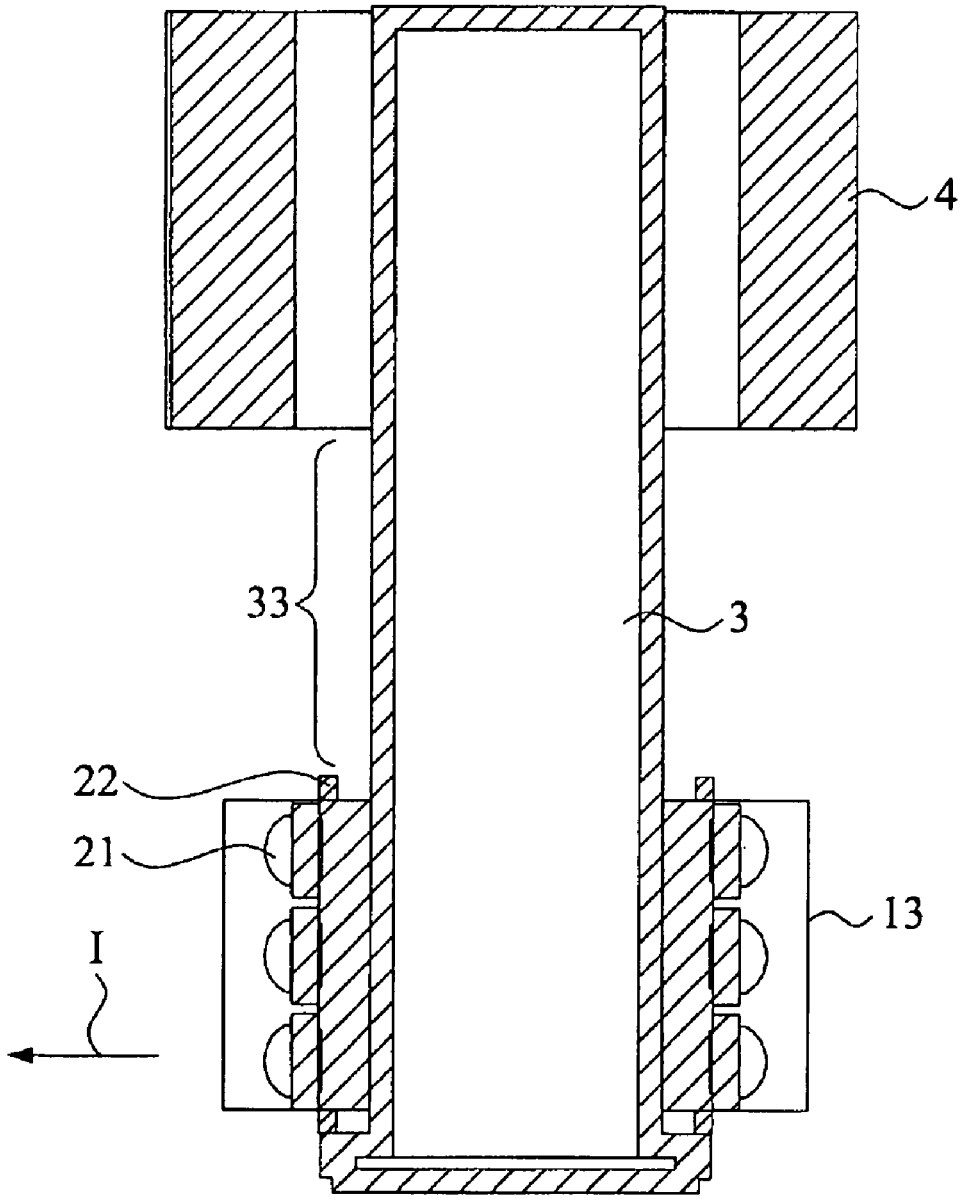
FIG. 8 is a cross-sectional view of the LED lighting assembly taken along line 8-8 of FIG. 7.
Figure 9:
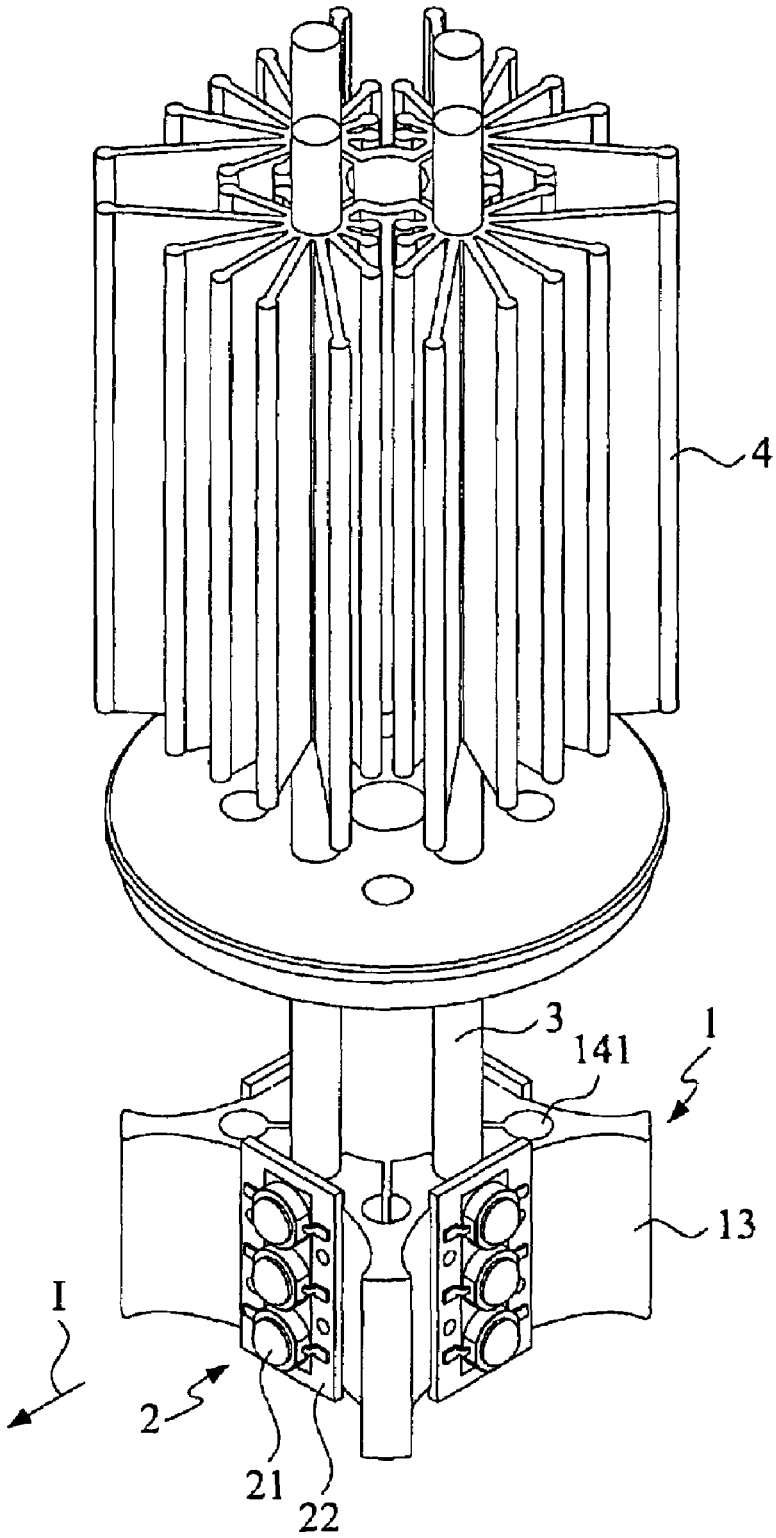
FIG. 9 is a schematic view of a second embodiment of the high power LED lighting assembly incorporated with a heat dissipation module constructed in accordance with the present invention, after the removal of its lamp shade.

Please refer to FIGS. 4 to 8. FIGS. 4 and 5 shows the exploded schematic views of the high power LED lighting assembly after the removal of the lamp shade. FIG. 6 is a top plan view of the heat exchange base of the LED lighting assembly. FIGS. 8 and 9 show a side view of the of the LED lighting assembly. As shown, the heat exchange base 1 is of approximately cubic shape comprising a plurality of LED configuration planes 11, a central hollow part 12, a plurality of thermal stress pressing structure 14 and an internal surface 15.

The LED configuration plane 11 is located on the outer surface of the heat exchange base 1. The hollow part 12 is arranged at the central part of the heat exchange base 1 with a top opening and a bottom opening, defining a space. The thermal stress pressing structure 14 comprises a through hole 141 and a channel 142 connecting to the through hole 141. The channels 142 communicate with the central hollow part 12. Electric wires for supplying power to the LEDs are arranged at the channel 142 of the thermal stress pressing structure 14.

Each of the LED configuration planes 11 is provided with a LED array 2. The LED array 2 comprises a plurality of LEDs 21 arranged in a predetermined pattern and a circuit board 22. The circuit board 22 is perforated with an aperture 221, in where the LEDs 21 are fitted to, such that the bottoms of LEDs and the bottom of the circuit board form a continuous flat surface for close contact between the LEDs and the LED configuration plane 11 of the hear exchange 1. The LED configuration planes 11 are coated with a layer of thermal conductive medium for leveling up the junctions among the LEDs and between the LEDs and the LED configuration planes 11, reducing the thermal resistance between the components. The heat exchange base 1 is made of heat sink material that allows rapid absorption, conduction, and dissipation of the thermal energy generated by the LEDs 21. In addition, the LED array 2 is replaceable, allowing the replacement of high watt and high power LEDs of different models.

The heat pipe 3 comprises a heated section 31, a cooling section 32, and a conducting section 33 that connects the heated section 31 to the cooling section 32. The heat pipe 3 contains a working fluid and is regularly cylindrical in shape. The heated section 31 is inserted into the central hollow part 12 of the heat exchange base 1, while the conducting section 33 extends outward from the top opening of the heat exchange base 1. The cooling section 32 of the heat pipe 3 is inserted to the central hollow part of the heat dissipation module 4.

During operation of the LED lighting assembly 100, the temperature of the heat exchange base 1 and the heat pipe 3 gradually increases. The raise in temperature causes the heat exchange base 1 and the heat pipe 3 to expand. As the heat exchange base 1 and the heat pipe 3 have different expansions, it generates a thermal stress at the interface between the internal surface 15 of the heat exchange base 1 and outer surface of the heat pipe 3, which enhances the contact between the internal surface 15 of the heat exchange base 1 and the heat pipe 3. The thermal stress increases as the temperature increases. The thermal stress acting on the thermal stress pressing structure 14 of the heat exchange base 1 makes the heat exchange base 1 clamp to the heat pipe 3, thus lowers the thermal resistance between the heat exchange base 1 and the heat pipe 3 and enhances the conduction of the thermal energy therebetween.

When the LEDs 21 of the LED array 2 are electrically powered and illuminates, the thermal energy generated is conducted through the heat exchange base 1 to the heated section 31 of the heat pipe 3. The working fluid of the heated section 31 is heated and vaporized. A pressure difference is generated between the vapor at the cooling section 32 and the working liquid at the heated section 31. The pressure difference promotes the vapor to flow from the conducting section to the cooling section 32 and assists the heat removal therefrom.

The vapor flowed to the cooling section 32 of the heat pipe 3 carries heat which is transmitted to and absorbed by the heat dissipation module 4 mounted to the cooling section 32. The heat dissipation module 4 comprises a plurality of fins extended radially from the hollow part of the heat dissipation module 4. The fins provide large surface areas for dissipation of heat. Thereby, the heat dissipation module 4 absorbs the thermal energy carried by the vaporized working fluid and dissipates the heat through the fins. Therefore, the heated and vaporized working fluid is cooled and condenses into liquid form. By means of the structure of the heat pipe 3, the condensed working fluid flows back by capillary action to the heated section 31. Through the vaporization and condensation of the working fluid, the thermal energy is repeatedly and rapidly dissipated to the outside.

The lamp shade 5 covers the heat exchange base 1, the LED arrays 2, the heat pipe 3, and the heat dissipation module 4. The lamp shade 5 comprises a plurality of longitudinal heat dissipating vents 51 located in the vicinity of the heat dissipation module 4 to allow the heated air surrounding the heat dissipation module 4 to exchange by convection.

The lamp shade 5 is connected to the heat dissipation module 4. The connection between the lamp shade 5 and the heat dissipation module 4 is coated with a thermal conductive material which may be viscous liquid, adhesive pads allowing direct adhesion, solidifiable material or other medium that facilitates the conduction of the thermal energy. In addition, the lamp shade 5 may be kept at a predetermined distance from the heat dissipation module 4 and provided with a fan additionally to enhance convection and heat transfer. Also, the external surface of the lamp shade 5 may be coated, adhered, or bonded with a layer of high radiation substance, for radiating the heat therefrom.

Furthermore, the heat exchange base 1 comprises a plurality of lighting auxiliary structures 13 which protrudes outwards from the two sides of the LED configuration plane 11 to a predetermined length. The light source auxiliary structures 13 assist focusing or diverging the light source generated by the LEDs 21 of the LED array 2. In the embodiments illustrated, the bottoms of the LEDs 21 are adhered flat to the LED configuration planes 11, while the LED configuration planes 11 are parallel to the heat pipe 3. The light produced by the LEDs 21 is projected perpendicular to the heat pipe 3 to the surroundings. Alternatively, by means of bending the brackets of the LEDs 21, or by slantly inserting the circuit boards 22 into the LED configuration planes 11, the LEDs 21 can be arranged at a specified angle on the LED configuration planes 11 of the heat exchange base 1, to allow the light generated by the LEDs 21 to project towards areas slantly above or below the exchange base 1 in every direction. The number of LED arrays 2 used may be varied according to brightness requirement. It is understandable that a single array with a sufficient number of LEDs may be used.

Figure 10:
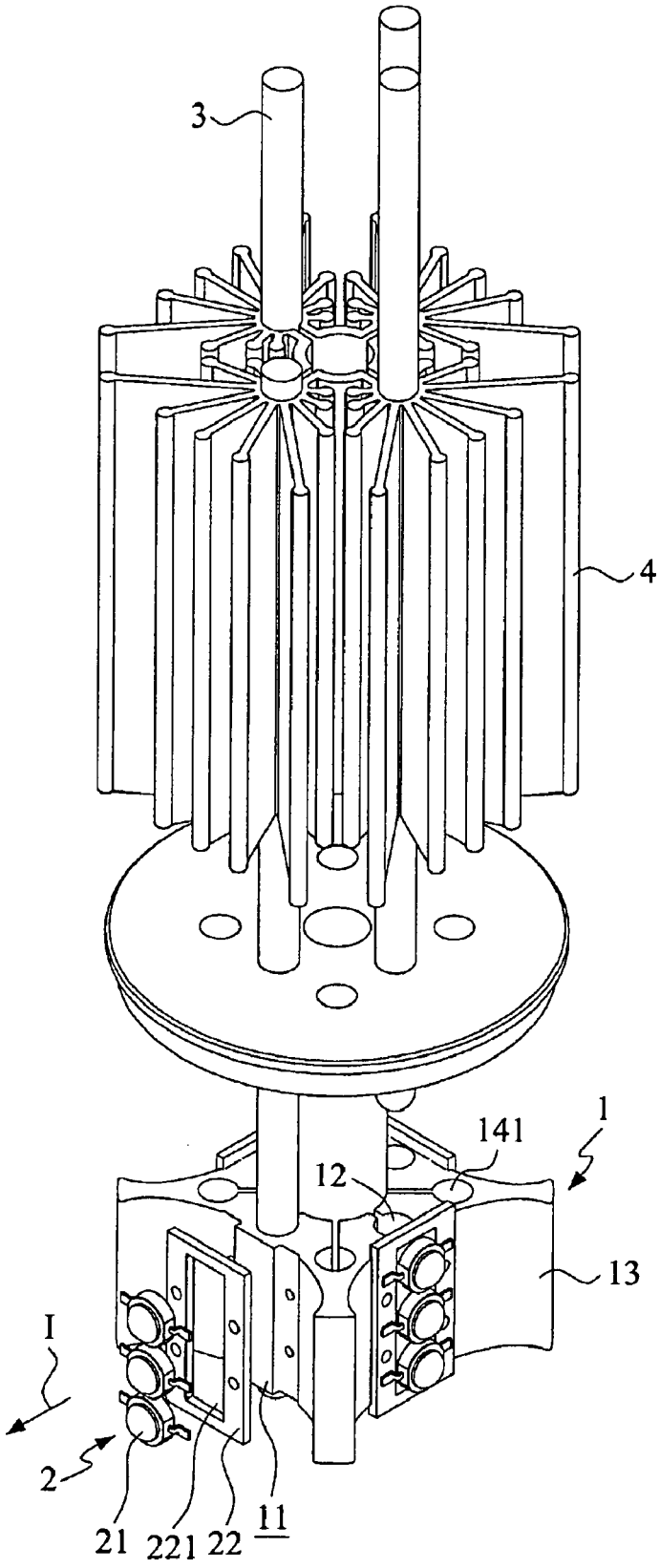
FIG. 10 is a partial exploded view of the high power LED lighting assembly of FIG. 9.
Figure 11:
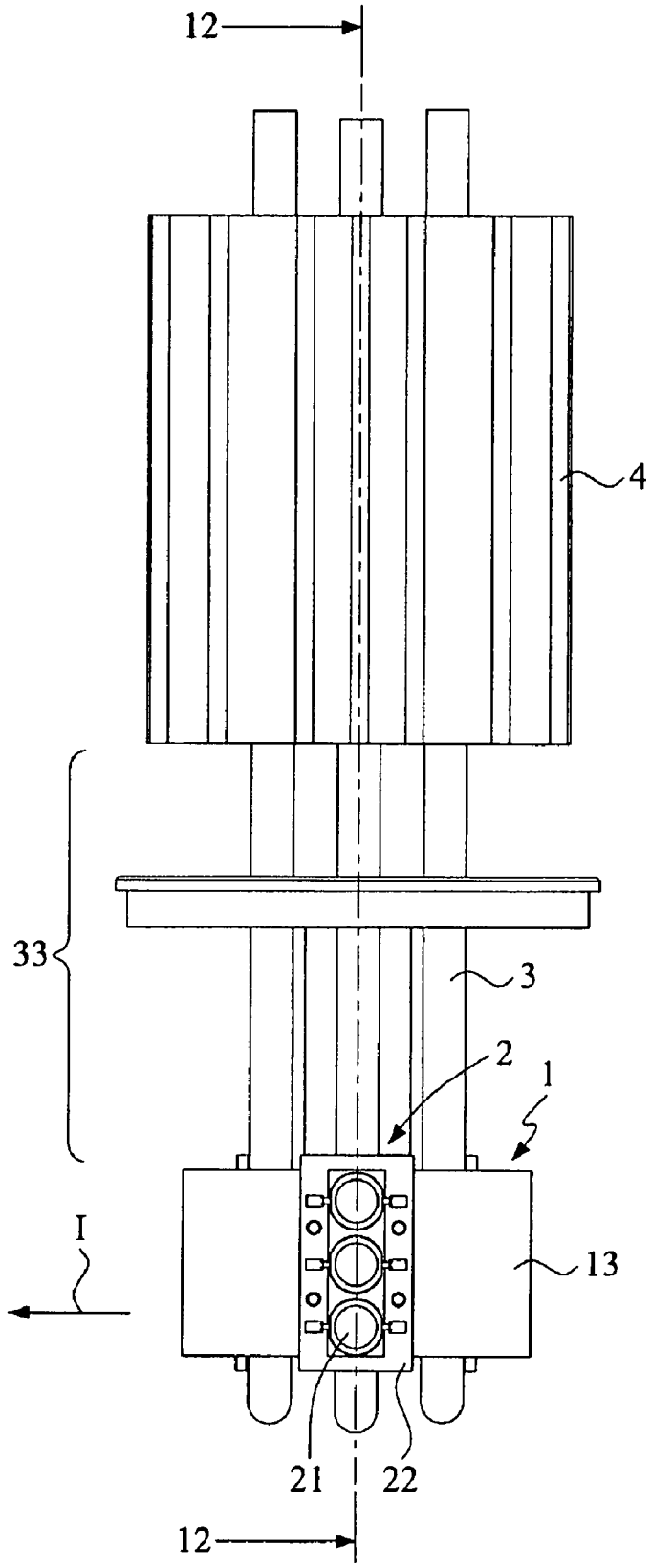
FIG. 11 is a schematic side view of the high power LED lighting assembly of FIG. 9.
Figure 12:
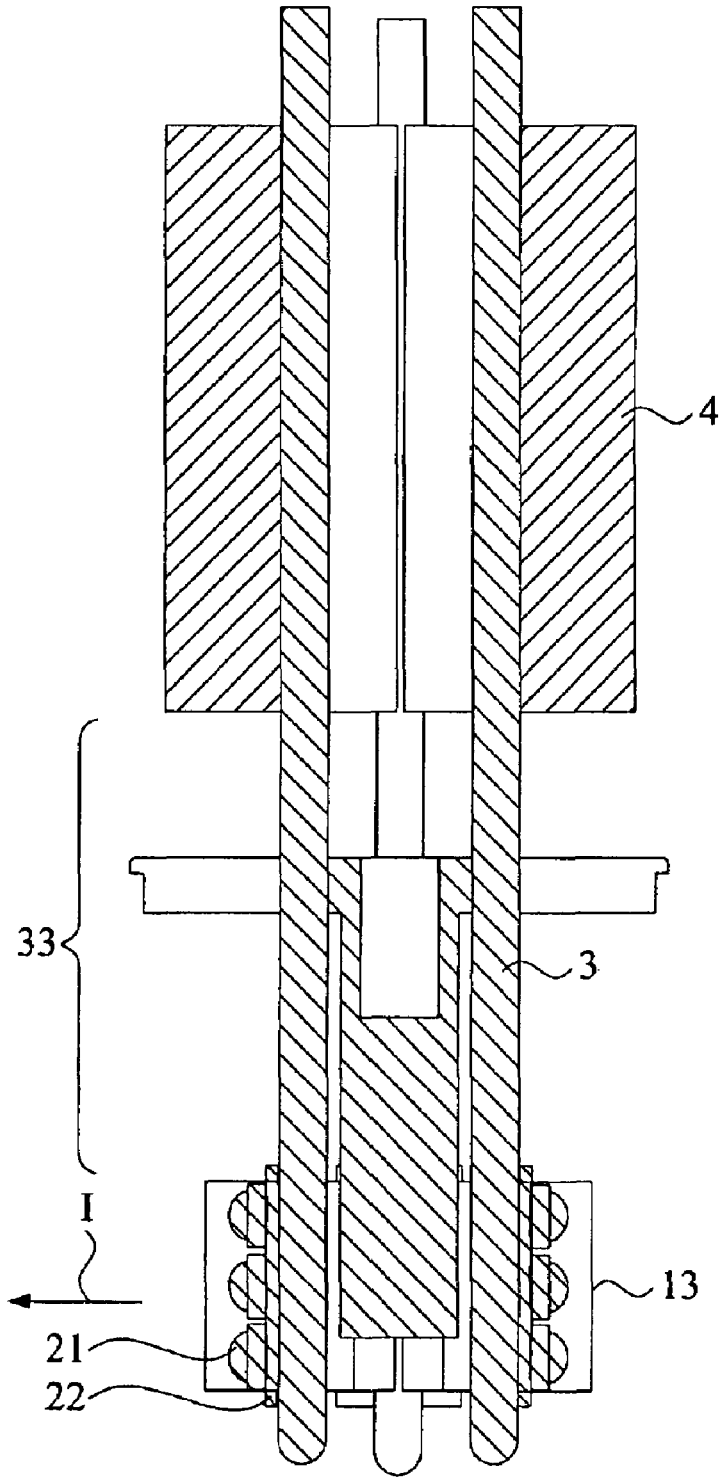
FIG. 12 is a cross-sectional view of the LED lighting assembly taken along line 12-12 of FIG. 11.

FIG. 9 is a schematic view of a second embodiment of the high power LED lighting assembly incorporated with a heat dissipation module constructed in accordance with the present invention, after the removal of its lamp shade. FIG. 10 is a partial exploded view of the high power LED lighting assembly of FIG. 9. FIGS. 11 and 12 show the side views of the LED lighting assembly of FIG. 9.

The second embodiment is different from the first embodiment in that the heat exchange base 1 comprising a plurality of peripheral hollow parts 12 arranged at selected location of the heat exchange base 1, while running through the top and bottom of the said heat exchange base 1. Each of the peripheral hollow parts 12 is inserted with a heat pipe 3. That is, the peripheral heat pipes 3 are arranged circularly around the central hollow part 12 of the heat exchange base 1, and each peripheral hollow part 12 is adjacent to one of the LED configuration planes 11, allowing the thermal energy generated by the LEDs 21 of the LED array 2 to be conducted through the heat exchange base 1 to the heated section 31 of the heat pipe 3.

The present invention has been described with reference to the preferred embodiment of this present invention that provides a high power LED lighting assembly that is incorporated with heat dissipation module, wherein the shape of the heat pipe 3 can be tubular, rectangular, or that of a slab or other varieties. The dimension of the heat pipe may be varied according to requirements, and is made of heat conductive material. The heat dissipation module may be of any specified form and shape, e.g. cross-typed, cylindrical, fin-typed, etc., and may be made by aluminum extrusion, die casting, mold injection or mechanical machining.

The heat pipe and fins are simple in structure, easy for installation and cheap for manufacturing. This allows the structure of the present invention can be varied and the application of the present invention is broad. The heat dissipation module can be applied in different fields and incorporated to many devices, such as indoor lighting, street lamps, and high power LED device While the invention has been described in connection with what is presently considered to the most practical and preferred embodiments, it is to be understood that the invention is not to be limited to the disclosed embodiments, but on the contrary, is intended to cover various modifications and equivalent arrangement included within the spirit and scope of the appended claims.

What is claimed is:

1. A LED lighting assembly, comprising:

a heat exchange base, comprising at least one LED configuration plane and at least one central hollow part, the LED configuration plane thereof being located on an outer surface of the heat exchange base;

at least one LED array, comprising a plurality of LEDs, each LED being positioned on the LED configuration plane of the heat exchange base at a predetermined angle for projection;

at least one heat pipe, comprising a heated section, a cooling section and a conducting section which connects the heated section to the cooling section and containing a working fluid, in which the heated section is inserted into the central hollow part of the heat exchange base and a connecting channel extends from the heat exchange base; and a heat dissipation module, being arranged at the cooling section of the heat pipe;

wherein when a thermal energy generated by the LED is conducted from the heat exchange base to the heated section of the heat pipe, the working fluid in the heat pipe is heated and flows from the conducting section to the cooling section and transmits heat to the heat dissipation module at the cooling section to dissipate the thermal energy;

wherein the heat exchange base comprises at least one lighting auxiliary structure protruding outwardly from two sides of the LED configuration plane to a predetermined length for assisting focusing or diverging of light generated by the LEDs of the LED array.

2. The LED lighting assembly as claimed in claim 1, wherein the LED lighting assembly further comprises a lamp shade, which covers the heat pipe, the heat exchange base, the LED array and the heat dissipation module, the lamp shade having a plurality of heat dissipating vents located in the vicinity of the heat dissipation module to allow the heated air surrounding the heat dissipation module to dissipate by convection.

3. The LED lighting assembly as claimed in claim 1, wherein the LED lighting assembly comprises a plurality of peripherial hollow parts arranged at specified locations of the heat exchange base for insertion of heat pipes, and each peripheral hollow part is located adjacent to each of the LED configuration planes, in order to facilitate the conduction of the thermal energy generated by the LEDs of the LED array through the heat exchange base to the heated section of the heat pipes.

4. The LED lighting assembly as claimed in claim 1, wherein the LED array comprises at least one circuit board having an aperture for receiving the LEDs, such that a bottom portion of the LEDs and a bottom surface of the circuit board form a continuous flat surface for close contact between the LEDs and the LED configuration plane.

5. A LED lighting assembly, comprising:

a heat exchange base, comprising at least one LED configuration plane and at least one central hollow part, the LED configuration plane thereof being located on an outer surface of the heat exchange base;

at least one LED array, comprising a plurality of LEDs, each LED being positioned on the LED configuration plane of the heat exchange base at a predetermined angle for projection;

at least one heat pipe, comprising a heated section, a cooling section and a conducting section which connects the heated section to the cooling section and containing a working fluid, in which the heated section is inserted into the central hollow part of the heat exchange base and a connecting channel extends from the heat exchange base; and a heat dissipation module, being arranged at the cooling section of the heat pipe;

wherein when a thermal energy generated by the LED is conducted from the heat exchange base to the heated section of the heat pipe, the working fluid in the heat pipe is heated and flows from the conducting section to the cooling section and transmits heat to the heat dissipation module at the cooling section to dissipate the thermal energy;

wherein the hollow part is provided with a top opening and a bottom opening, defining an internal space for the insertion of the heat pipe and having an internal surface, and the heat exchange base further comprises at least one thermal stress pressing structure having a through hole and a connecting channel in communication with the hollow part and being arranged at a selected location at the heat exchange base, wherein during operation, the heat generated from the LEDs produces a thermal stress acts on the thermal stress pressing structure, makes the heat exchange base clamping to the heat pipe and lowers the thermal resistance between the heat exchange base and the heat pipe, and electrical wires are arranged at the connecting channel for supplying power to the LEDs.

6. A LED lighting assembly, comprising:

a heat exchange base, comprising at least one LED configuration plane and at least one central hollow part, the LED configuration plane thereof being located on an outer surface of the heat exchange base;

at least one LED array, comprising a plurality of LEDs, each LED being positioned on the LED configuration plane of the heat exchange base at a predetermined angle for projection;

at least one heat pipe, comprising a heated section, a cooling section and a conducting section which connects the heated section to the cooling section and containing a working fluid, in which the heated section is inserted into the central hollow part of the heat exchange base and a connecting channel extends from the heat exchange base; and a heat dissipation module, being arranged at the cooling section of the heat pipe;

wherein when a thermal energy generated by the LED is conducted from the heat exchange base to the heated section of the heat pipe, the working fluid in the heat pipe is heated and flows from the conducting section to the cooling section and transmits heat to the heat dissipation module at the cooling section to dissipate the thermal energy;

wherein the LED configuration plane is parallel to the heat pipe and a bottom of the LED is adhered flat to the LED configuration plane, so as to allow the light produced by the LED to be projected perpendicular to the heat pipe to the surroundings.

* * * * *